United States Patent [19]

Sumoto

[11] Patent Number: 4,480,365

[45] Date of Patent: Nov. 6, 1984

[54] SUPPORT MECHANISM FOR A DRIVEN DRUM FOR FEEDING UNIFORM WIDTH TAPE IN A KNITTED TAPE MANUFACTURING DEVICE

[75] Inventor: Tamotsu Sumoto, Osaka, Japan

[73] Assignee: Yugen Kaisha Manthree Shokai, Osaka, Japan

[21] Appl. No.: 454,686

[22] Filed: Dec. 30, 1982

[30] Foreign Application Priority Data

Sep. 24, 1982 [JP] Japan ..... 57-167188

[51] Int. Cl.[3] ..... B21D 43/00

[52] U.S. Cl. ..... 29/2.1; 29/2.15; 29/2.22

[58] Field of Search ..... 29/2.1, 2.11, 2.12, 29/2.13, 2.14–2.25; 83/54, 175; 26/82

[56] References Cited

U.S. PATENT DOCUMENTS

| | | | |
|---|---|---|---|
| 893,300 | 7/1908 | Bewsic | 29/2.25 |
| 1,753,645 | 4/1930 | Camfield | 29/2.24 |
| 1,955,281 | 4/1934 | Gardner et al. | 29/2.23 |
| 3,776,077 | 12/1973 | Letsche | 83/175 |
| 4,047,272 | 9/1977 | King et al. | 29/2.2 |

*Primary Examiner*—Howard N. Goldberg
*Assistant Examiner*—Steven E. Nichols
*Attorney, Agent, or Firm*—Koda and Androlia

[57] ABSTRACT

In a knitted tape manufacturing device of the type designed to stretch and rotate a cylindrical knitted fabric around two drums and one roller and to continuously cut the fabric in a tape shape off from the upper circumferential edge portion thereof along a certain width of the fabric in a bias direction and including a support mechanism of the driven drum for feeding uniform width tape in the knitted tape manufacturing device wherein the support mechanism of the driven drum is adjustable so as to bring the axis of the pivot pin of the driven drum in the support mechanism into substantial agreement with the extended line of a tangent at the entering point at which the upper circumferential edge of the cylindrical knitted fabric enters the driven drum.

2 Claims, 6 Drawing Figures

SUPPORT MECHANISM FOR A DRIVEN DRUM FOR FEEDING UNIFORM WIDTH TAPE IN A KNITTED TAPE MANUFACTURING DEVICE

BACKGROUND OF THE INVENTION

1. Field of the Invention

This invention relates to a support mechanism for a driven drum for feeding uniform width tape in a knitted tape manufacturing device for continuously cutting a cylindrical knitted fabric in a bias direction.

2. Prior Art

A so-called knitted tape heretofore in use for clothing and the like is manufactured by continuously cutting the upper circumference of a cylindrical knitted fabric (including an upper circumferential edge and a longitudinal portion connecting to the edge and having a certain width) in a bias direction. As an example is mentioned a device for manufacturing a knitted tape wherein a cylindrical knitted fabric is passed from below in close contact around the outer circumferences of a driving drum, a driven drum, and a tension roller whose planes are respectively disposed at the vertices of a triangle which is rotated endlessly around the outer circumferences of the drums and the roller, the axis primarily of the driven drum and secondarily of the tension roller are tilted respectively at a suitable angle, the upper circumferential side of the knitted fabric continuously supplied from the driven drum is caused to rise in the direction of the fabric being delivered from the driving drum, and the raised width of the fabric is fixed as a set point of a desired width of the knitted tape and is continuously cut by cutters mounted near the top end of the driving drum. But in a conventional knitted tape manufacturing device (the principle of manufacturing a tape with a specified width by use of this device will later be described), a support mechanism for the driven drum is designed to permit adjustment of plane, height and tilt positions; however as a result of the construction of the device, when tilt adjustment is made, plane and height positions are also changed in cooperation with the tilt adjustment displacement even in the entering position of the upper circumferential edge Nu of a cylindrical knitted fabric with respect to the driven drum. For example, when it is desired to change the width of knitted tape, the entering point at which the upper circumferential edge Nu of cylindrical knitted fabric N enters a driven drum 2 changes from $P_2$ to $P'_2$ as shown in FIG. 5*a*. Accordingly, there is made not only an error in fixing the width of knitted tape but also creases are made in the upper circumferential portion, with the result that there has been a great obstacle to continuous cutting of the knitted tape.

SUMMARY OF THE INVENTION

This invention has for its object the removal of the disadvantages of the kind described above. The object is achieved by tilting the driven drum by keeping the entering point nearly constant at which the upper circumferential edge Nu of the cylindrical knitted fabric enters the driven drum.

A description will now be given of a preferred embodiment of the invention with reference to the accompanying drawings.

DETAILED DESCRIPTION OF THE INVENTION

Figure 1:
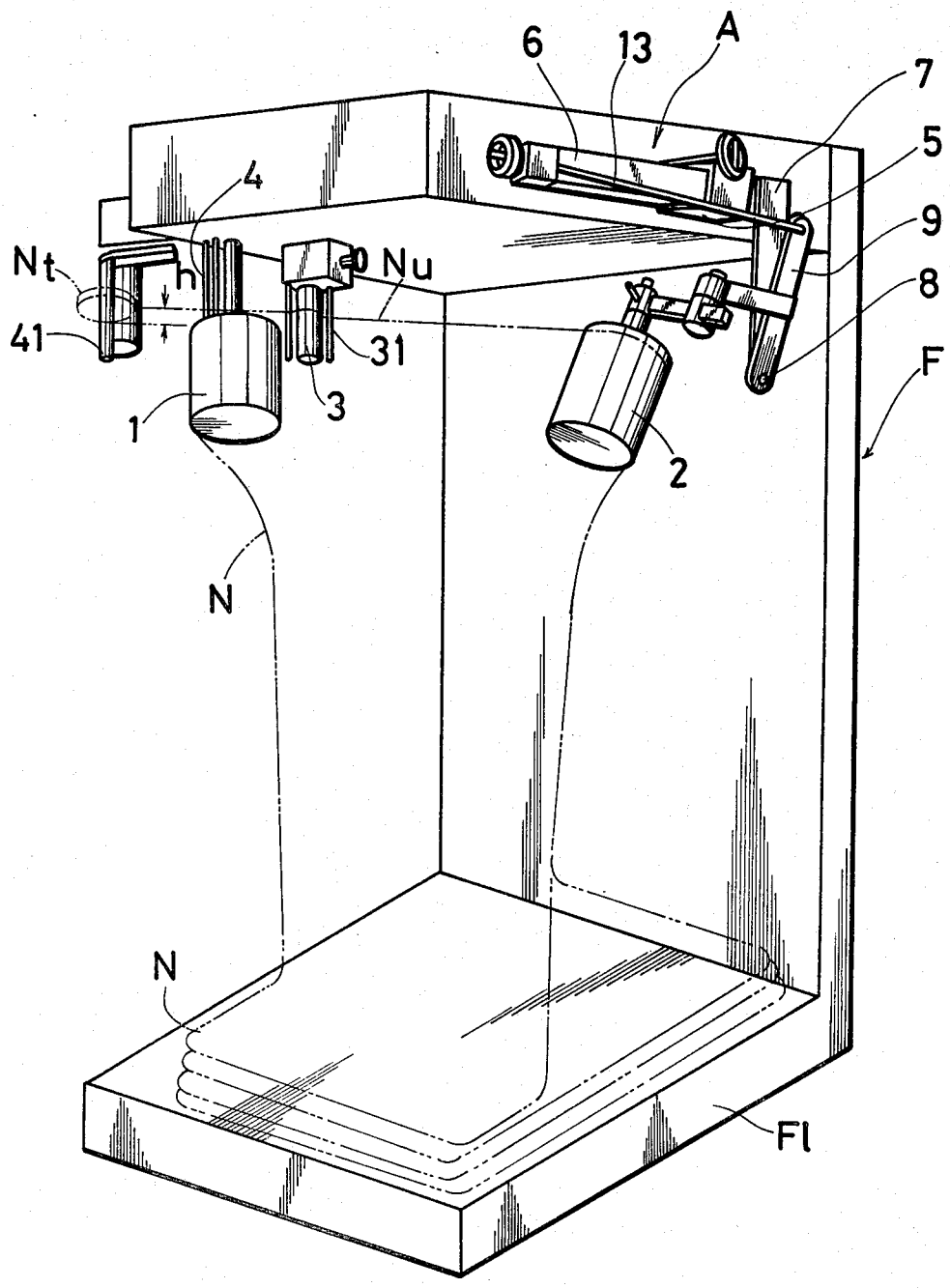
FIG. 1 is a perspective view of the whole of the device using support mechanism of the driven drum of the invention.

The illustrated knitted tape manufacturing device comprises a driving drum 1 whose axis of rotation is substantially vertical, a driven drum 2 whose axis is tiltably carried by a support mechanism A, a tension roller 3 lying between the driving drum 1 and the drum 2 and tiltably carried in a direction different from a direction of tilt of the driven drum 2, a pair of cutters 4 disposed near the upper end of the driving drum 1, and a tape takeup rod 41, whereby a cylindrical knitted fabric N, while the driving drum 1 and the tension roller 3 are being driven, is stretched in close contact around the outer circumferences of the driving drum l, driven drum 2, and tension roller 3 and is endlessly rotated so as to continuously cut the cylindrical knitted fabric raised to an amount of a tape width by the tilted driven drum 2 and tension roller 3 by means of the cutters 4 in a bias direction (in a bias direction with respect to the cylindrical knitted fabric) and to take up the knitted tape Nt by a takeup rod 41. The invention is intended to provide a support mechanism of the driven drum for feeding uniform width tape in the knitted tape manufacturing device and the mechanism is composed of the support mechanism A of the driven drum 2 comprising a slide rod 5 for adjusting the position of the driven drum 2 horizontally, a support rod 6 fixed at the end of the slide rod 5 and crossing the rod 5, a vertical rod 7 suspended from one end of the support rod 6, an inverted T-shaped link 9 journalled through a horizontal pivot pin 8 mounted at the lower end of the rod 7 and rotatable about the pin 8 in a vertical plane, a means 10 provided at the end of a lateral holding element 91 of the link 9 for adjusting the position of the driven drum 2, and an actuating rod 13 for rotating the link 9 about the pin 8 in a vertial plane, whereby the support mechanism A makes it possible to freely adjust the position of the driven drum 2 in accordance with the diameters of the driven drum 2 and of cylindrical knitted fabric N and also makes it possible for rotation of the link 9 about the pivot pin 8 in a vertical plane by the actuating rod 13 to permit tilting of the driven drum 2 substantially about an entering point $P_2$ in a diametrically vertical plane including the entering point $P_2$ by bringing the axis l of the pivot pin 8 into agreement substantially with an extended line of tangent t at the entering point $P_2$ at which the circumferential edge of the cylindrical knitted fabric N enters the driven drum 2.

In the drawings, the driving drum 1 is rotated clockwise by a motor (not shown) mounted within a frame suspended from the upper part of a frame F. The driven drum 2 is carried by the support mechanism A of the invention from the upper lateral side of the frame F. The tension roller 3 is rotated at the same peripheral speed as the driving drum 1 and in the same direction as the driving drum 1 by the above motor. A pair of cutters 4 having rotary blades (not shown) is intended to cut a cylindrical knitted fabric N disposed near the top side of the driving drum 1 in front of the drum 1. A description will be given of a principle of the uniform width tape feed mechanism of a knitted tape Nt conjugate to the invention and conventional technique with reference to the accompanying drawings. In order to continuously cut the knitted fabric N (shown in two-dotted chain lines in FIG. 1) in a bias direction into a knitted tape fabric Nt, the knitted fabric N is folded in layers and placed on a base F1 of a frame F so as to permit free successive delivery of the fabric N in order of the upper to the lower layer of the fabric N folded in layers on the base F1, and thereafter the circumferential portion of the cylindrical knitted fabric N is stretched and reeved over the driving drum 1, driven drum 2 and tension roller 3.

Figure 2:
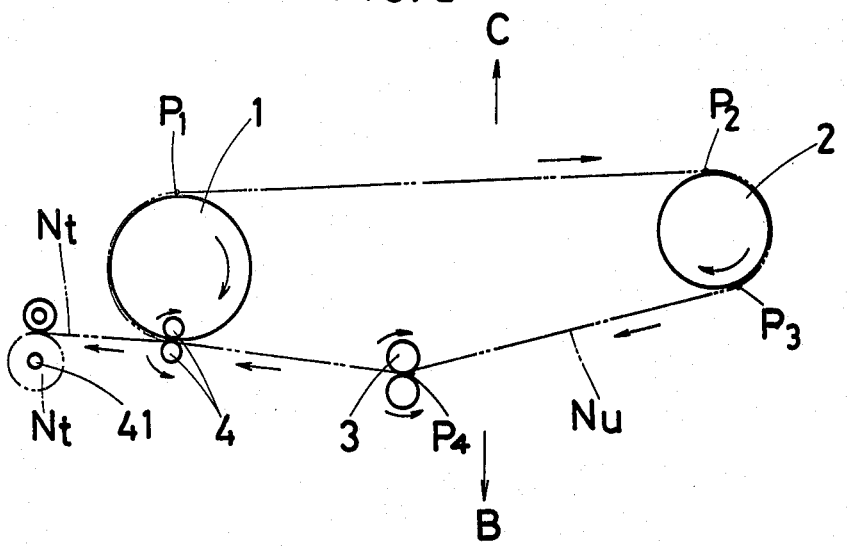
FIG. 2 is a plan view illustrating a cylindrical knitted fabric stretched in the state of the device in FIG. 1 being used.

FIG. 2 is a view, seen from above, of the state of the cylindrical knitted fabric N reeved over the driving drum 1, driven drum 2 and tension roller 3. An arrow B indicates a forward direction and an arrow C indicates a rearward direction of the stretched fabric. The upper circumferential edge Nu of the cylindrical knitted fabric N is fed from the upper front of the driving drum 1 approximately along the semicircumference of the drum 1 in a planar clockwise direction and is led to an entering point $P_2$ of the outer circumference of the driven drum 2 from an outgoing point $P_1$ away from the driving drum 1. Thereafter, the upper circumference of the cylindrical knitted fabric N is moved along the outer circumference of the driven drum 2, but because the axis of the driven drum 2 is tilted longitudinally (the upper portion of the driven drum 2 is tilted rearwardly and the lower portion thereof forwardly), the height of the outgoing point $P_3$ away from the driven drum 2 is raised from the height of the entering point $P_2$ and the driven drum 2 keeps its tilt angle, and the knitted fabric N is led from the outgoing point $P_3$ to an entering point $P_4$ of a tension roller 3. The peripheral speed of the tension roller 3 is equal to the peripheral speed of the driving drum 1 and rotated in the same direction.

The upper circumferential edge Nu of the cylindrical knitted fabric N maintains a tilt angle from the entering point $P_2$ to the outgoing point $P_3$ and is transferred to the entering point $P_4$ of the tension roller 3, and the upper circumferential side of the cylindrical knitted fabric N is elevated between the entering point $P_2$ and entering point $P_4$ to effect a first step of raising the width of a knitted tape Nt. The upper circumference side of the cylindrical knitted fabric N transferred to the tension roller 3 is transferred along the outer circumference of the tension roller, but the roller 3 is made tiltable in a transverse vertical plane, so that adjustment of the final height of the upper circumferential side of the cylindrical knitted fabric N, namely correct feeding of the knitted tape with a specified width thereof is effected. A pair of cutters 4 are mounted longitudinally of the drum 1 near the upper circumference of the driving drum 1 in front of the drum. The cylindrical knitted fabric N fed from the tension roller 3 is transferred to the driving drum 1 in the state of the fabric being raised as wide as a desired knitted tape width h (FIG. 1) in the position of the cutters 4, and the upper circumferential portion of the cylindrical knitted fabric N is cut continuously in a bias direction by the cutters 4 into a tape having the width h. The knitted tape Nt thus cut is separated from the upper circumferential portion of cylindrical knitted fabric N and is taken up by a tape takeup rod 41, and the upper circumferential edge Nu newly formed by cutting of the cylindrical knitted fabric N is fed along the driving drum 1 to the outgoing point $P_1$ in FIG. 2.

Figure 3:
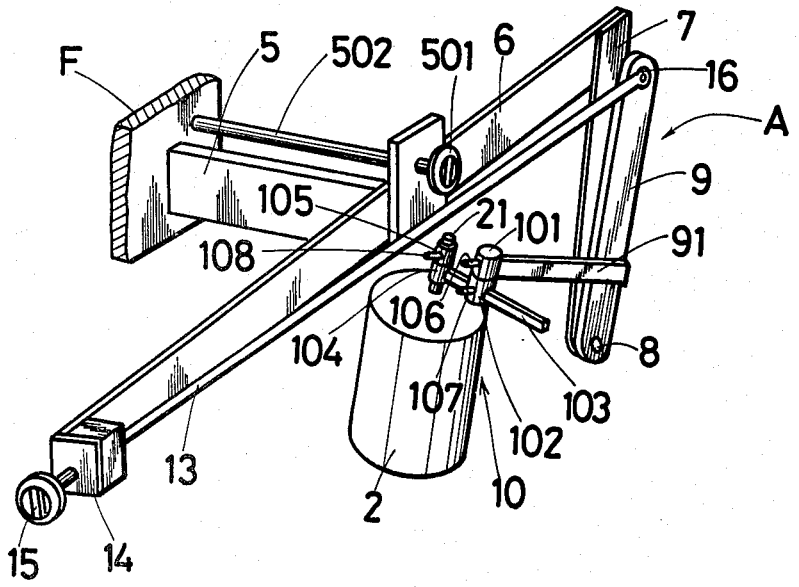
FIG. 3 is a perspective view, partly broken away, of the support mechanism for the driven drum of the invention.
Figure 4:
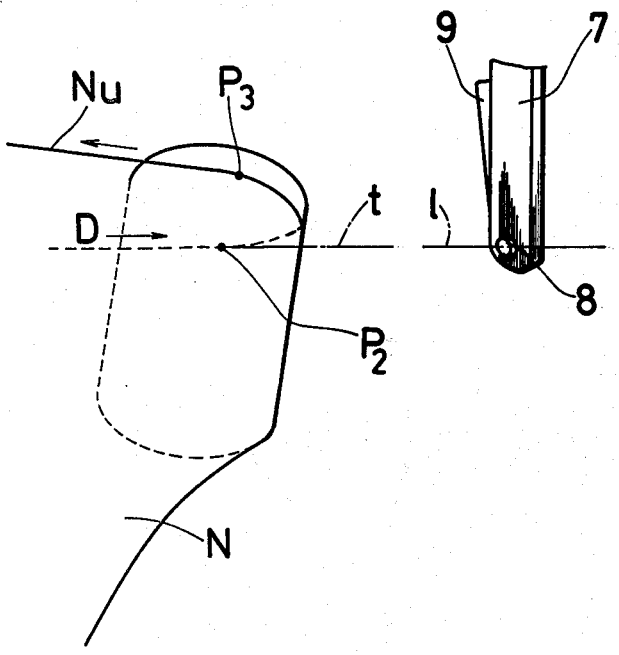
FIG. 4 is a diagram illustrating the relation between the driven drum and the entering postion of the cylindrical knitted fabric in FIG. 1.
Figure 5:
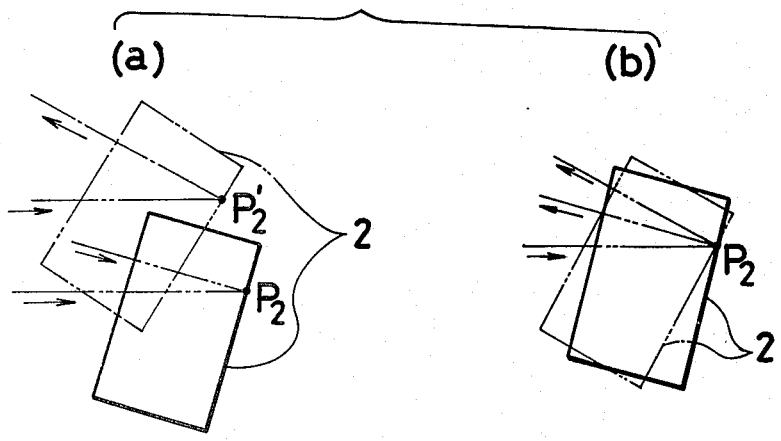
FIGS. 5*a* and 5*b* are diagrams illustrating a difference between the driven drum of a conventional device and that of the invention when the cylindrical knitted fabric enters the driven drum.

The support mechanism A of this invention, as shown in FIG. 3, includes an actuating rod 13, and the rear end of the rod 13 is pivotally supported through a pin 16 on the upper end of a link 9, while the forward end of the rod 13 is connected to the connecting member 14 of a support rod 6. The actuating rod 13 ortates the link 9 about the pivot pin 8 by the operation of a handwheel 15 in a vertical plane parallel to the support rod 6. A slide rod 5 is intended to adjust itself by moving itself horizontally toward and away from the side wall of a frame F in proportion to the diameter of the cylindrical knitted fabric N and is slidden horizontally through a rod 502 by operating a handwheel 501. A means 10 for adjusting a position of the driven drum 2 has a fixed member 101 fixed to the end of a transverse holding member 91 of the link 9, and a rotary member 102 is pivotally supported on the fixed member 101 to permit free rotation in a horizontal plane and is adjustably locked to the member 101 at a desired angle by a screw 106. A rod 103 rectangular in section is transversely slidably inserted through the rotary member 102. The rod 103 is adjusted in accordance with the diameter of the cylindrical knitted fabric N and locked to the member 102 by a screw 107. At the end of the rod 103 is provided a fixed member 104 and the member is provided at the upper portion thereof with an attachment member 105 of the driven drum 2 and a shaft 21 of the driven drum 2 is fixed to the upper portion of the member 104 by a screw 108 to permit free vertical adjustment. The driven drum 2 is rotatably around the shaft 21 by bearings (not shown) to support the shaft 21. Because of the support mechanism A described above, as shown in FIG. 4 by a relation between the axis l of a pivot pin 8 at the lower end of an inverted T-shaped link 9 and the entering point $P_2$ of the upper circumferential edge Nu of the cylindrical knitted fabric N entering the driven drum 2, the upper circumferential edge Nu of the cylindrical knitted fabric N is moved in an arrow D indicated direction and comes into contact with the drum 2 at the entering point $P_2$. Tangent t at this entering point $P_2$ is adjusted by a means 10 for adjusting the position of the driven drum 2 so as to be in agreement substantially with the axis l of a pivot pin 8, and the driven drum 2 is tilted substantially about the entering point $P_2$ in a diametrical vertical plane including the entering point $P_2$ by actuating the actuating rod 13 to rotate the link 9 about the pivot pin 8 in a vertical plane. Thus, in accordance with a change in the diameter of the cylindrical knitted fabric N, the diameter of the driven drum 2, and the width h of the knitted tape Nt, the driven drum 2 can be tilted in the state of the entering point P at which the upper circumferential edge Nu of the cylindrical knitted fabric N enters the driven drum 2 being held substantially in fixed position as shown in FIG. 5*b*.

In a preferred embodiment, as shown in FIG. 1, there are provided two guide rods 31, 31 located transversely of the tension roller 3. The two guide rod 31, 31 are tilted transversely in cooperation with the tension roller 3 in a transversely vertical plane of the tension roller 3 to increase the area of contact with the tension roller 3. Accordingly, smoothing of the creases of the circumferential portion of the cylindrical knitted fabric N is sufficiently effected between the roller 3 and the driving drum 1 and correct feed of uniform width knitted tape Nt is effected by making fine adjustment of transverse tilt.

As described above, a support mechanism according to the invention facilitates feed of a uniform width tape in accordance with the diameter of the cylindrical knitted fabric N, the diameter of the driven drum 2, and the width h of the knitted tape, and when the knitted tape Nt is manufactured by reeving the cylindrical knitted fabric over the drums and tension roller and positioning the driven drum 2 in place, not only adjustment of a tilt angle for obtaining a desired tape width h but also tilting of the driven drum 2 can be very easily carried out without changing the entering point $P_2$ at which the knitted fabric N enters the driven drum 2, with the result that such disadvantages in terms of lost time and economy as defective tapes due to insecure feed of tape by transfer of the entering point $P_2$ or due to discontinuance of continuous cutting of tape because of the creases left on the fabric N are removed. The invention, in this manner, is very high in industrial applicability.

I claim:

1. In a knitted tape manufacturing device including a driving drum whose axis of rotation is substantially vertical, a driven drum, a support mechanism for the driven drum to tiltably carry the axis of rotation of the driven drum, a tension roller lying between said driving roller and said driven drum and tiltably carried in a direction different from a direction of tilt of said driven drum, a pair of cutters disposed in the neighborhood of the upper end of said driving drum, and a tape takeup rod, whereby a cylindrical knitted fabric, while the driving drum and said tension roller are being driven, is reeved in close contact around the outer circumferences of said driving drum, driven drum and tension roller and is endlessly rotated so as to continuously cut the cylindrical knitted fabric raised to an amount of a tape width by the tilted driven drum and tension roller by means of said cutters in a bias direction and to take up said cylindrical knitted fabric by said takeup rod, said support mechanism comprising:

a slide rod for adjusting the position of said driven drum horizontally;

a support rod fixed to the end of said slide rod and crossing the rod;

a vertical rod suspended from one end of said support rod;

an inverted T-shaped link journalled through a horizontal pivot pin mounted at the lower end of said vertical rod and rotatable about said pin in a vertical plane;

a means provided at the end of a lateral holding element of said link for adjusting the position of said driven drum; and an actuating rod for rotating said link about said pivot pin in a vertical plane;

whereby said support mechanism makes it possible to freely adjust the position of said driven drum in accordance with the diameter of said driven drum and of cylindrical knitted fabric and also makes it possible for rotation of said link about said pivot pin in a vertical plane by said actuating rod to permit tilting of said driven drum substantially about an entering point in a diametrically vertical plane including said entering point by bringing the axis of said pivot point into substantial agreement with an extended line of a tangent at said entering point at which the circumferential edge of said cylindrical knitted fabric enters said driven drum.

2. A support mechanism according to claim 1 wherein said tension roller is provided parallely on both sides with a pair of vertical guide rods said rods being tiltable integrally with said tension roller.

* * * * *